US007275840B2

(12) United States Patent
Holten

(10) Patent No.: US 7,275,840 B2
(45) Date of Patent: Oct. 2, 2007

(54) LUMINAIRE

(75) Inventor: Petrus Adrianus Josephus Holten, Winterswijk (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/549,233

(22) PCT Filed: Mar. 15, 2004

(86) PCT No.: PCT/IB2004/050248

§ 371 (c)(1),
(2), (4) Date: Sep. 12, 2005

(87) PCT Pub. No.: WO2004/083719

PCT Pub. Date: Sep. 30, 2004

(65) Prior Publication Data

US 2006/0187661 A1 Aug. 24, 2006

(30) Foreign Application Priority Data

Mar. 17, 2003 (EP) ..... 03100671

(51) Int. Cl.
*F21V 7/00* (2006.01)

(52) U.S. Cl. ..... 362/298; 362/303; 362/364

(58) Field of Classification Search ..... 362/298, 362/303, 364
See application file for complete search history.

(56) References Cited

U.S. PATENT DOCUMENTS 2,713,631 A * 7/1955 Spinetta ..... 362/225
5,988,836 A * 11/1999 Swarens ..... 362/364

FOREIGN PATENT DOCUMENTS

DE 29519708 U1 * 4/1997

* cited by examiner

*Primary Examiner*—Renee Luebke
*Assistant Examiner*—Mary Zettl

(57) ABSTRACT

A luminaire for indirect lighting has a main reflector, a counter-reflector with a light emission window in a plane T. The counter-reflector and reflector are oppositely arranged. The main reflector has a reflecting surface built up from a plurality of facets n having a curvature in cross-section. The curvature of each respective facet n is such that light coming from a light emission window and hitting a given facet n is reflected through an angle of reflection $\Phi_n <= \alpha_n - \beta$, in which, $\beta$ is a smallest angle of reflection with the plane T at which glare is just counteracted, and $\alpha_n$ is a greatest angle of reflection with the plane T at which reflected light just clears the counter-reflector.

13 Claims, 3 Drawing Sheets

LUMINAIRE

Figure 1:
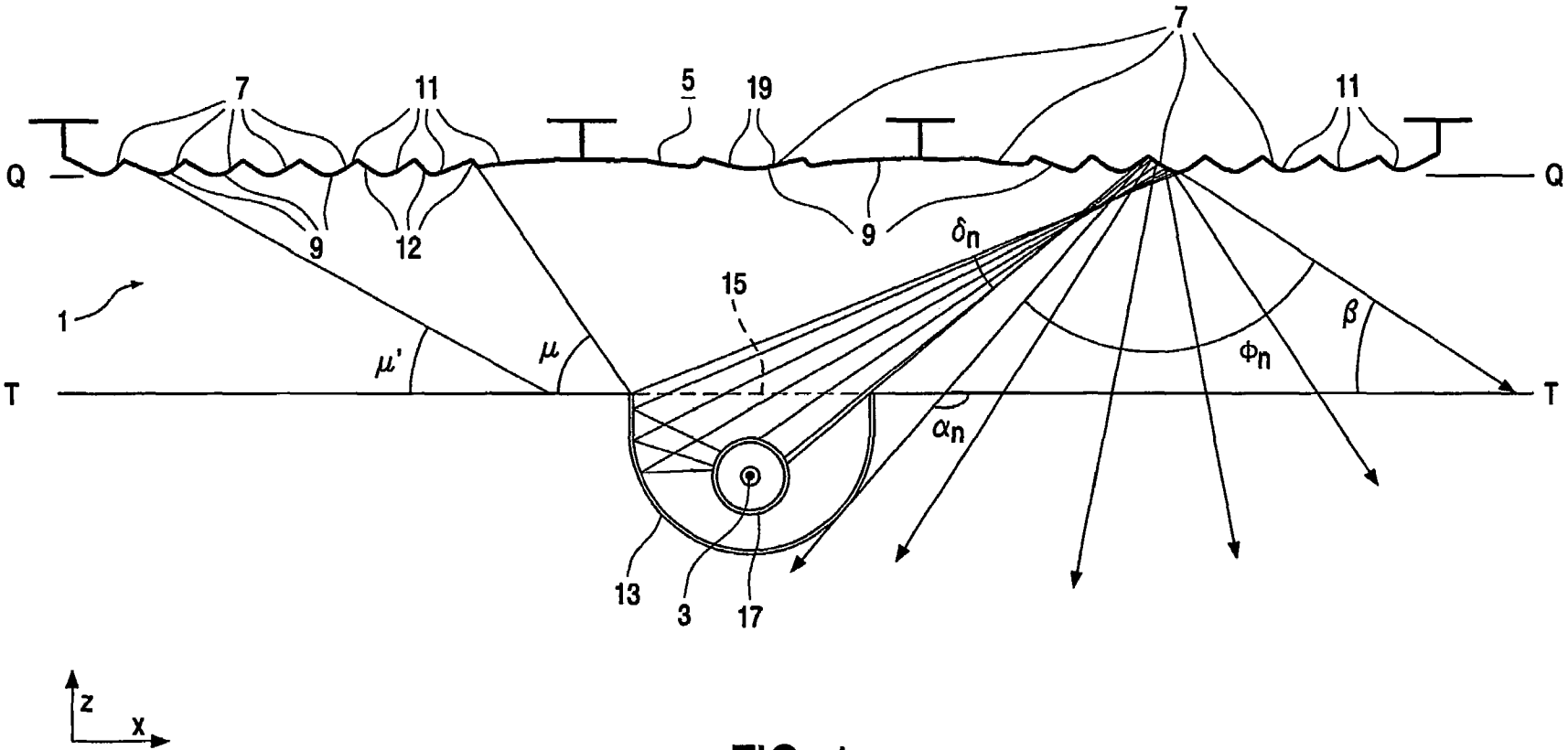

The invention relates to a luminaire comprising:

an elongate reflector extending along an axis and comprising a plurality of elongate facets extending along one another and along said axis, each with a reflecting surface, which facets have a curvature in cross-section;

an elongate concave counter-reflector extending along said axis such that the reflecting surfaces of the facets and a light emission window of the counter-reflector, which is situated in a plane T, mutually face one another;

contact means positioned between the reflector and the counter-reflector for accommodating at least one electric lamp.

The invention further relates to an assembly of an electric lamp and a luminaire.

Such a luminaire is known from U.S. Pat. No. 1,900,551. The known luminaire is designed for use as an indirect light source for general lighting purposes. The facets of the reflector are straight or convexly curved towards the counter-reflector, as viewed in cross-section. The known luminaire provided with facets that are straight in cross-section has the disadvantage that the facets reflect the light originating from the electric lamp with an undesirable high brightness, which increases the risk of glare and renders a control of contrast differences with the surroundings more difficult. A light beam of such an undesirable high brightness, moreover, is often felt to be unpleasant by an observer. If the known luminaire is provided with facets that are convex in cross-section, the curvature of the facets is such and the facets are positioned and oriented with respect to the electric lamp such that light originating from the light source and incident on the facets is partly reflected back by the facets into the luminaire, especially onto the electric lamp and the counter-reflector. It is a disadvantage of the known luminaire, when having facets that show a curvature in cross-section, that a light beam is obtained from the luminaire in a comparatively unfavorable and inefficient manner.

It is an object of the invention to counteract the disadvantages of the luminaire mentioned in the opening paragraph. To achieve this object, the luminaire of the kind described in the opening paragraph is characterized in that the curvature of a facet n is such that during operation of the electric lamp light coming from the light emission window and incident on each respective facet n is reflected as a beam having a beam angle $\Phi_n$, a maximum angle of reflection at which light of said beam is reflected being at most equal to $\alpha_n$, wherein $\alpha_n$ is an angle of reflection with respect to the plane T at which the light is reflected such that it just shears along the counter-reflector.

The luminaire according to the invention may then comprise facets which have a concave or convex curvature towards the counter-reflector in cross-section. Alternatively, the luminaire according to the invention may comprise convexly shaped and concavely shaped facets. The curvature may follow, for example, an arc of a circle, parabola, hyperbol, or ellipse, or it may alternatively be achieved in that the facets are composed of sub-facets. The reflector may comprise central facets which are present directly opposite the light emission window, which facets are straight in cross-section and form, for example, a (sharp) point such that an at least substantially equal distribution of light quantities over the two sides of the luminaire is achieved. These central facets may be at least substantially entirely screened off against direct observation by the counter-reflector, so that the observer is protected against possible glare caused by light reflected by these straight facets.

Giving the facets the curvature as defined in the characterizing portion of claim 1 achieves that each respective facet n supplies a light beam with a beam angle $\Phi_n$. When an observer views the luminaire according to the invention, in which $\Phi_n$ is at least substantially equal to $\alpha_n$ for a facet n, it was found that this observer has a perception as if an integral, somewhat dimmed light beam is provided by this facet n of the luminaire. The individual facets of the luminaire can be distinguished by the observer owing to transition regions of contrasting brightness between the facets. The light reflected as a beam by each respective facet n has a maximum beam angle of $\Phi_n=\alpha_n$. The value of the angle $\alpha_n$ is determined from a construction of the paths of light rays in the plane of cross-section of the luminaire. Dazzling of an observer was found to be counteracted with the luminaire according to the invention. It is achieved at the same time that light originating from the electric lamp during operation is not reflected back into the luminaire by the facets owing to the shape of the facets as defined in the characterizing portion of claim 1. A light beam can thus be obtained from the luminaire in a comparatively favorable and efficient manner.

In a favorable embodiment, the luminaire according to the invention is characterized in that a minimum angle of reflection with plane T at which light of the beam is reflected is at least equal to $\beta$, wherein $0 \leqq \beta < \alpha_n$, with preferably $\beta=30°$. The light reflected as a beam by each respective facet n has a maximum beam angle of $\Phi_n=\alpha_n-\beta$. An agreed standard requirement in lighting technology is that the angle $\beta$ in a horizontal position of plane T is at least 30° in the case of luminaires serving for illumination from the ceilings of spaces containing office furniture with picture screens, so as to prevent mirroring and glare on said screens. For $\beta>0$, all light is reflected in the direction of the office furniture. $\beta$ may have values other than 30°, for example 20°, for the illumination of spaces having other applications.

The beam angle $\Phi_n$ in the luminaire according to the invention may be adjusted within the given limits $\alpha_n$ and $\beta$ by means of small variations in the curvature of the facet n. It is favorable then when the curvature of facets lying closest to the contact means has a radius $R_n$ which is greater than the radius of curvature of facets situated farther away from the contact means. As a result, the facets may have at least substantially the same dimension in cross-section, while it is achieved at the same time that each respective facet n supplies a light beam with more or less the same beam angle $\Phi_n$, given said dimension in cross-section of the facets. It was found in experiments for luminaires thus shaped that an observer experiences an optical effect as if light of the same brightness is radiated by all facets. It was also found that said optical effect is especially functional if it is true for the radius $R_n$ of each respective facet n, which facet n is irradiated with an angle of aperture $\delta_n$ from the light emission window, that $0.5\delta_n \leqq R_n \leqq 2\delta_n$, wherein $R_n$ is the radius of curvature of a facet n expressed in mm and $\delta_n$ is expressed in degrees.

A luminaire according to the invention with which the brightness of the generated light can be adjusted by an additional method is characterized in that the curvature of each facet is bounded by an end portion in the form of a respective fold extending along the axis, such that in cross-section said fold shows a bend through at least an angle $\gamma=30°$ and a radius of curvature $R_{fil}$ lying in a range of 0.1 mm$\leqq R_{fil} \leqq$3 mm. The end portion thus formed acts as a strongly diverging, luminous linear element with which the brightness of the transition region between two mutually adjoining facets can be adjusted. Given values of the radius of curvature $R_{fil}$ below the minimum value of the above range, the transition region will be observed to have an insufficiently stronger brightness, or no stronger brightness at all. Given values of $R_{fil}$ above the maximum value of the above range, an observer will perceive the brightness of the transition region as being too high. The folded end portion of a respective facet located closest to plane T will always receive light as a rule during operation of the electric lamp and will accordingly always be functional as a bright linear element. The folded end portion of a respective facet lying farthest away from plane T is usually screened off against direct reception of light by an adjacent facet and will accordingly as a rule not be functional as a bright linear element. The latter end portion, therefore, is usually not optimized for its function as a luminous linear element, but rather optimized with regard to its mechanical properties, facilitating the manufacture of reflector material from a flat plate.

In a favorable embodiment, the luminaire according to the invention is characterized in that the reflector has a width/height ratio of at least 4:1, while the reflector may have an overall convex or concave curved shape in cross-section. Said width/height ratio gives the luminaire a small constructional or incorporation depth, which renders it suitable for use in comparatively shallow false ceilings and/or comparatively low spaces. Particularly preferred is a luminaire according to the invention that has a reflector whose facets lie substantially in a plane Q, which plane Q extends parallel to the plane T, such that a substantially minimum constructional or incorporation depth is achieved.

In an alternative embodiment, the luminaire according to the invention is characterized in that the reflector and/or the counter-reflector are provided with light-transmitting means, for example openings (holes) 14 or optical waveguide elements (optical fibers), which are preferably evenly distributed over the surface of the reflector and/or counter-reflector. If the light-transmitting means are provided in the reflector, it has become possible for an observer to perceive a subtle indirect lighting coming from a carrier, for example a ceiling, to which the luminaire is fastened. If the light-transmitting means are provided on the counter-reflector, a difference in brightness between the reflector and the counter-reflector as perceived by an observer will be counteracted, so that it is achieved that an observer experiences the optical effect that light of the same brightness is given off by the entire luminaire.

A possible embodiment of the luminaire according to the invention is characterized in that mutually adjacent facets are interconnected by connecting surfaces, such that the connecting surfaces located closer to the contact means enclose a greater angle μ with the plane T than the connecting surfaces located farther away from the contact means and are oriented such that they reflect at least substantially no light originating from the electric lamp during operation of this lamp. This counteracts the risk that the connecting surfaces of the luminaire could give off light of a comparatively high brightness, which may be experienced as unpleasant by an observer. Alternatively, the connecting surfaces may be provided with openings designed for the removal of hot air coming from the electric lamp Light losses through such openings are thus counteracted.

The object of the invention may alternatively be achieved by means of an assembly of a luminaire in one of the embodiments as described above and an electric lamp, characterized in that the counter-reflector is an integral part of the electric lamp, for example a coating, for example of aluminum oxide. The coating leaves a portion of the circumference of the electric lamp permeable to light, which permeable portion acts as the light emission window. It is achieved with such an assembly that the separate counter-reflector can be dispensed with, whereby a very small incorporation or constructional depth of the assembly is realized. The incorporation or mounting depth is a minimum if the facets in the luminaire according to the invention lie at least substantially in a plane Q, which plane Q extends parallel to the plane T.

Figure 2:
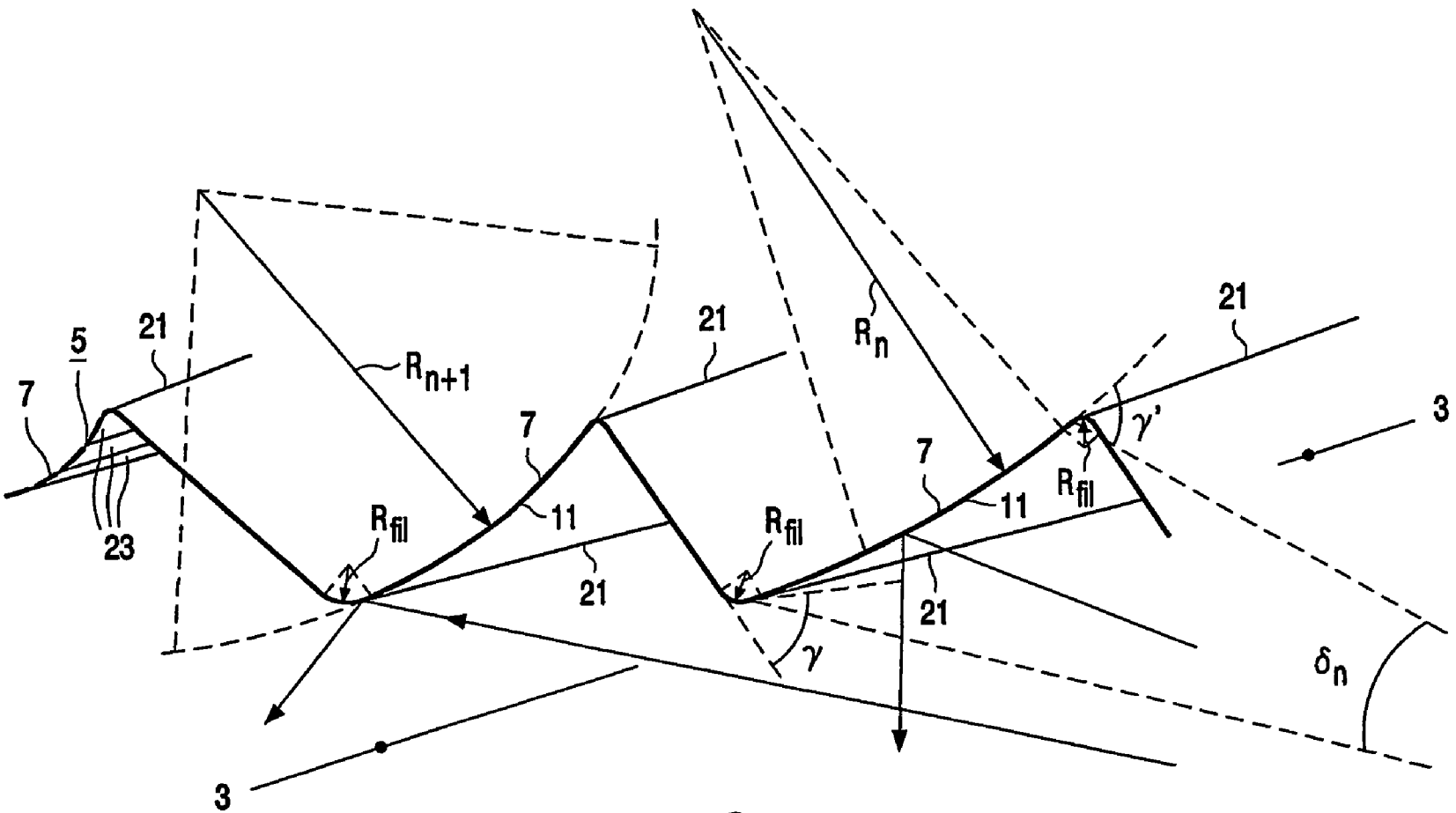

Embodiments of the luminaire according to the invention are diagrammatically shown in the drawing, in which FIG. 1 is a cross-sectional view of an embodiment of a luminaire according to the invention, and FIG. 2 is a perspective cross-sectional view of a detail of the luminaire of FIG. 1.

Figure 3:
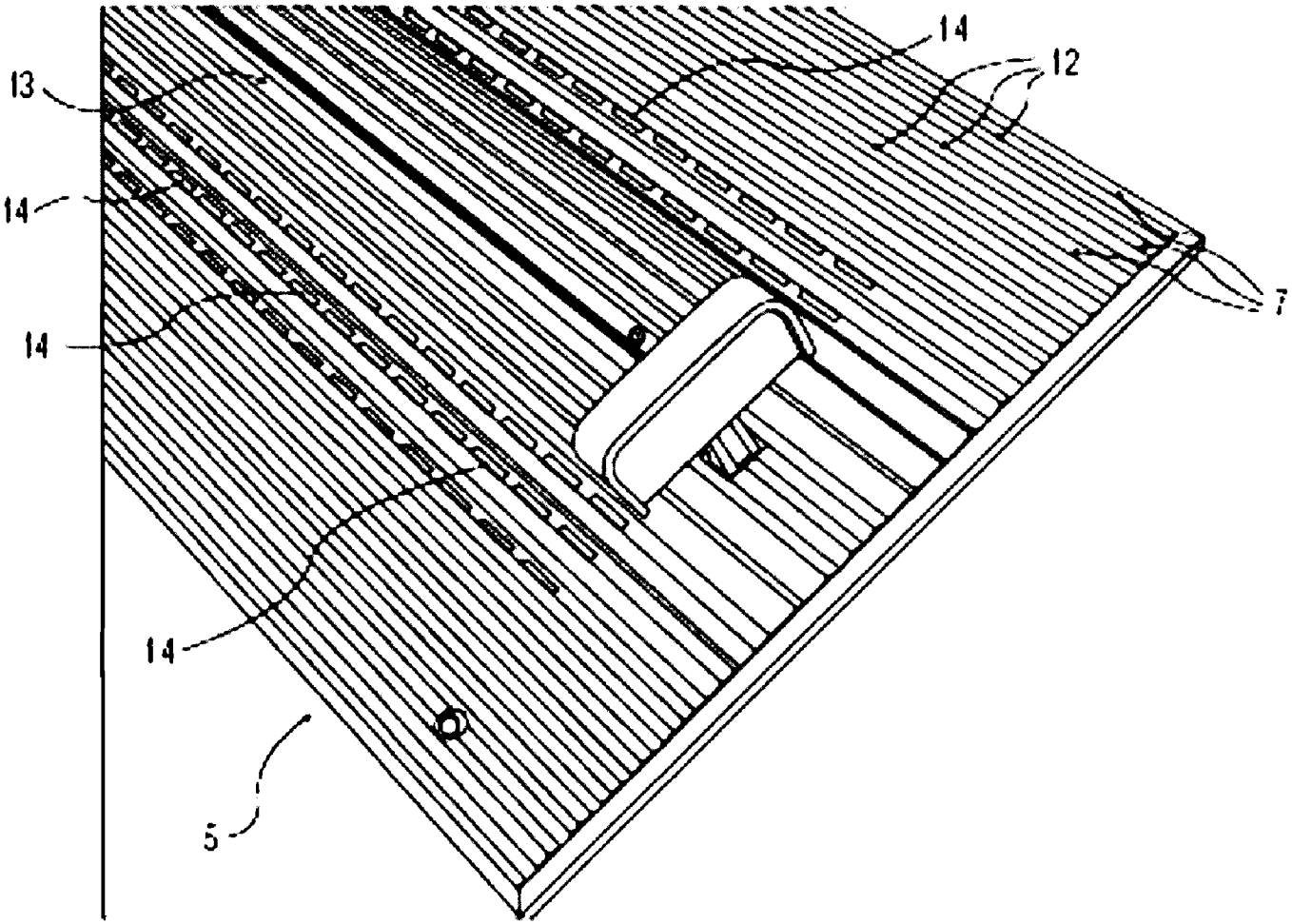

FIG. 3 shows a detail of the light-transmitting means of the Luminaire of FIG. 1, in which the reflector and/or the counter-reflector are provided with openings (holes) or optical waveguide elements (optical fibers).

FIG. 1 shows a luminaire 1 comprising an elongate reflector 5 extending along an axis 3 and comprising a plurality of elongate facets 7 extending along one another and along the axis, each with a reflecting surface 9, which facets have a curvature 11 in cross-section. Mutually adjoining facets are interconnected by connecting surfaces 12. Connecting surfaces located closer to the contact means enclose a greater angle μ with a plane T than the angle μ' enclosed between the plane T and connecting surfaces located farther away from the contact means. The connecting surfaces are oriented such that they reflect at least substantially no light originating from the electric lamp during operation of this lamp. The luminaire also comprises an elongate concave counter-reflector 13 extending along the axis, such that the reflecting surfaces 9 of the facets 7 and a light emission window 15 of the counter-reflector 13, which window lies in a plane T, face one another. Between the reflector and the counter-reflector, the luminaire is provided with contact means (not shown) in which an electric lamp 17 is held. The lamp may be a discharge lamp, for example a tubular low-pressure mercury vapor gas discharge lamp, or an incandescent lamp, for example a halogen incandescent lamp. The reflector and counter-reflector may be manufactured, for example, from synthetic resin, for example polythene, or from bent metal plating, for example aluminum. The reflecting surface may be a layer provided on the (counter-)reflector, for example by means of vapor deposition, for example of anodized aluminum, or may be a mirroring coating foil. Each facet n is irradiated from the light emission window at an angle of aperture $\delta_n$ for the relevant facet n. The curvature of a large majority of the facets 7 is such that light incident on the facets 7 from the light emission window 15 is reflected at a beam angle $\Phi_n$, such that $\Phi_n=\alpha_n-\beta$. β is the minimum angle of reflection with plane T at which light of the beam is reflected and is chosen such that glare is just prevented; $\beta\approx40°$ in FIG. 1. $\alpha_n$ is a greatest angle of reflection with the plane T at which the light is reflected so as to shear just along the counter-reflector. $\alpha_n$ and β are also the maximum and minimum reflection angles, respectively, at which light of the beam is reflected. A number of central facets 19 from among the facets 7 are straight in cross-section. The facets of the reflector shown in FIG. 1 lie substantially in a plane Q, which plane Q extends parallel to the plane T. The reflector 5 has a width/height ratio of at least 4:1, which ratio is approximately 20:1 in FIG. 1. The luminaire has a comparatively small mounting or incorporation depth as a result of this ratio and is thus suitable for use in comparatively shallow false ceilings and/or comparatively low spaces.

FIG. 2 shows a detail of a number of facets 7 of the reflector 5 of the luminaire 1 of FIG. 1, in which it is apparent that the facets are bounded on either side by respective end portions 21 in the form of respective folds extending along the axis 3, such that in cross-section a fold has a curvature through at least an angle $\gamma=30°$, for example in FIG. 2 $\gamma=60°$ and $\gamma'=70°$, and has a radius of curvature $R_{fil}$ in a range of 0.1 mm$\leqq R_{fil} \leqq$3 mm, with in FIG. 2 $R_{fil}\approx 2.5$ mm. It is also shown that the curvature 11 of facets located closer to the contact means has a radius $R_n$ which is greater than the radius $R_{n+1}$ of the curvature 11 of facets located farther away from the contact means, for example 15 and 20 mm in FIG. 2. The angle of aperture $\delta_n$ at which the facet with radius $R_n$ is irradiated from the light emission window is approximately 15°. It is true for this facet, but also for most other facets, that $0.5\delta_n \leqq R_n \leqq 2\delta_n$, wherein $R_n$ is the radius of the curvature of a facet n expressed in mm and $\delta_n$ is expressed in degrees. By way of illustration, FIG. 2 shows a facet whose curvature is obtained by means of sub-facets 23. The other facets shown in FIG. 2 have a curvature in accordance with an arc of a circle.

FIG. 3 shows a detail of the light-transmitting means of the Luminaire of FIG. 1, in which the reflector 5 and/or the counter-reflector 13 are provided with openings (holes) 14 or optical waveguide elements (optical fibers), which are preferably evenly distributed over the surface of the reflector 5 and/or counter-reflector 13. If the light-transmitting means are provided in the reflector 5, it has become possible for an observer to perceive a subtle indirect lighting coming from a carner, for example a ceiling, to which the luminaire is fastened. If the light-transmitting means are provided on the counter-reflector, a difference in brightness between the reflector 5 and the counter-reflector 13 as perceived by an observer will be counteracted, so that it is achieved that an observer experiences the optical effect that light of the same brightness is given off by the entire luminaire.

The invention claimed is:

1. A luminaire comprising:

an elongate reflector extending along an axis and comprising a plurality of elongate surface features extending along one another and along said axis, each with a reflecting surface, said surface feature having a curvature in cross-section;

an elongate concave counter-reflector extending along said axis such that the reflecting surfaces of the surface features and a light emission window of the counter-reflector, said window being in a plane T, mutually face one another;

contact means positioned between the reflector and the counter-reflector for accommodating at least one electric lamp, wherein the curvature of a surface feature n is such that during operation of the electric lamp light coming from the light emission window and incident on each respective surface feature n is reflected as a beam having a beam angle $\Phi_n$ with respect to the plane T, bounded by a minimum angle of reflection $\beta$ with respect to the plane T and a maximum angle of reflection $\alpha_n$, wherein $\alpha_n$ is an angle of reflection with respect to the plane T at which the light is reflected such that it shears along the counter-reflector, and wherein the light reflected as a beam at an angle $\Phi_n$ bounded by said minimum angle of reflection $\beta$ and said maximum angle of reflection $\alpha_n$ by each respective surface feature n, whereby there are transition regions of contrasting brightness between the respective surface features n.

2. A luminaire as claimed in claim 1, wherein $\beta=30°$.

3. A luminaire as claimed in claim 1, wherein the curvature of surface features lying closest to the contact means has a radius $R_n$ which is greater than the radius of curvature of surface features situated farther away from the contact means.

4. A luminaire as claimed in claim 1, wherein it is true for the radius $R_n$ of each respective surface feature n, said surface feature n being irradiated at an angle of aperture $\delta_n$, with respect to the plane Q, from the light emission window, that $0.5\delta_n \leqq R_n \leqq 2\delta_n$, wherein $R_n$ is the radius of curvature of a surface feature n expressed in mm and $\delta_n$ is expressed in degrees.

5. A luminaire as claimed in claim 1, wherein the curvature of a surface feature is bounded by an end portion on either side each said end portion having the shape of a respective fold extending along the axis, such that in cross-section said fold shows a bend through at least an angle $\gamma=30°$ and a radius of curvature $R_{fil}$ lying in a range of 0.1 mm $\leqq R_{fil} \leqq$3 mm.

6. A luminaire as claimed in claim 1, wherein the reflector has a width/height ratio of at least 4:1.

7. A luminaire as claimed in claim 1, wherein the surface features lie substantially in a plane Q, which plane Q extends parallel to the plane T.

8. A luminaire as claimed in claim 1, wherein the surface features are formed from sub-surface features.

9. A luminaire as claimed in claim 1, wherein the reflector and/or counter-reflector are/is provided with light-transmitting means.

10. A luminaire as claimed in claim 9, wherein the light-transmitting means are openings, said openings being evenly distributed over the surface of the reflector and/or counter-reflector.

11. A luminaire as claimed in claim 1, wherein the reflector has central surface features located directly opposite the light emission window, which surface features are straight in cross-section.

12. A luminaire as claimed in claim 1, wherein mutually adjacent surface features are interconnected by connecting surfaces, such that the connecting surfaces located closer to the contact means enclose a greater angle $\mu$ with the plane T than the connecting surfaces located farther away from the contact means and are oriented such that they reflect substantially no light originating from the electric lamp during operation of the electric lamp.

13. An assembly of a luminaire as claimed in claim 1, and an electric lamp, wherein the counter-reflector is an integral part of the electric lamp.

* * * * *